US009190040B2

(12) United States Patent
Hashimoto

(10) Patent No.: US 9,190,040 B2
(45) **Date of Patent: *Nov. 17, 2015**

(54) BASS DRUM

(71) Applicant: Yamaha Corporation, Hamamatsu-Shi, Shizuoka-Ken (JP)

(72) Inventor: Ryuji Hashimoto, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/025,290

(22) Filed: Sep. 12, 2013

(65) Prior Publication Data

US 2014/0069256 A1 Mar. 13, 2014

(30) Foreign Application Priority Data

Sep. 13, 2012 (JP) ..... 2012-201858

(51) Int. Cl.
*G10D 13/02* (2006.01)

(52) U.S. Cl.
CPC ..... *G10D 13/027* (2013.01); *G10D 13/02* (2013.01); *G10D 13/021* (2013.01); *G10D 13/022* (2013.01); *G10D 13/023* (2013.01); *G10D 13/024* (2013.01)

(58) Field of Classification Search
CPC . G10D 13/027; G10D 13/022; G10D 13/021; G10D 13/024; G10D 13/02
USPC ..... 84/411 R, 414, 411 M, 420, 421
See application file for complete search history.

(56) References Cited

U.S. PATENT DOCUMENTS

| | | | | |
|---|---|---|---|---|
| 879,521 | A | 2/1908 | Chein | |
| 1,654,592 | A | 1/1928 | Lockwood | |
| 1,809,050 | A | 6/1931 | Logan | |
| 4,308,782 | A * | 1/1982 | Hartry | 84/414 |
| 4,325,281 | A * | 4/1982 | Hardy | 84/411 M |
| 4,567,807 | A * | 2/1986 | Robinson | 84/411 M |
| 4,589,323 | A * | 5/1986 | Belli et al. | 84/411 R |
| 4,742,753 | A * | 5/1988 | Speed | 84/414 |

(Continued)

FOREIGN PATENT DOCUMENTS

| | | |
|---|---|---|
| JP | S64-54095 U | 4/1989 |
| JP | 3004768 U | 11/1994 |

(Continued)

OTHER PUBLICATIONS

Japanese Office Action dated Sep. 24, 2014 issued in corresponding Japanese Application JP 2012-201860 (partial English translation).

(Continued)

*Primary Examiner* — David Warren
*Assistant Examiner* — Christina Schreiber
(74) *Attorney, Agent, or Firm* — Dickstein Shapiro LLP

(57) ABSTRACT

A bass drum 10 has a hollow cylindrical shell 11, a drumhead 12 mounted on an opening end of the shell 11 to form a striking surface, and a striking surface attachment 13 provided on the reverse side of the drumhead 12. The striking surface attachment 13 is formed of an elastic sheet. At least a part of an outer area of the striking surface attachment 13 is fixed to the drumhead 12 and a central area of the striking surface attachment 13 is not fixed to the drumhead 12. As a result, the bass drum 10 can generate a struck sound having both deep bass sound and clear attack.

17 Claims, 15 Drawing Sheets

(56) References Cited

U.S. PATENT DOCUMENTS

| | | | | |
|---|---|---|---|---|
| 4,947,725 | A * | 8/1990 | Nomura | 84/723 |
| 5,159,139 | A * | 10/1992 | Beals et al. | 84/414 |
| 5,492,047 | A * | 2/1996 | Oliveri | 84/411 M |
| 5,864,077 | A * | 1/1999 | Gatzen | 84/414 |
| 5,892,168 | A * | 4/1999 | Donohoe | 84/411 M |
| 6,043,420 | A | 3/2000 | Arnold | |
| 6,245,979 | B1 * | 6/2001 | Campbell | 84/411 M |
| 6,291,754 | B1 | 9/2001 | Gatzen et al. | |
| 6,297,177 | B1 * | 10/2001 | Belli et al. | 442/242 |
| 6,525,249 | B1 | 2/2003 | Suenaga | |
| 6,580,023 | B2 * | 6/2003 | Belli | 84/411 R |
| 6,686,526 | B2 | 2/2004 | Ezbicki | |
| 6,784,352 | B2 * | 8/2004 | Suenaga | 84/411 R |
| 6,927,330 | B2 * | 8/2005 | May | 84/411 R |
| 6,949,701 | B2 * | 9/2005 | Okumura | 84/411 R |
| 7,074,994 | B2 * | 7/2006 | Belli | 84/411 R |
| 7,214,867 | B1 * | 5/2007 | Gatzen et al. | 84/411 R |
| D611,524 | S * | 3/2010 | Lawrence, III | D17/22 |
| 8,173,886 | B2 * | 5/2012 | Hashimoto | 84/723 |
| 8,294,013 | B2 * | 10/2012 | Lento | 84/411 R |
| 2002/0096035 | A1 | 7/2002 | Good | |
| 2003/0136244 | A1 * | 7/2003 | Okumura | 84/411 R |
| 2004/0149120 | A1 * | 8/2004 | Maruhashi et al. | 84/411 R |
| 2013/0042744 | A1 * | 2/2013 | Hsien | 84/414 |
| 2014/0060284 | A1 | 3/2014 | Yoshino | |
| 2014/0069256 | A1 | 3/2014 | Hashimoto | |
| 2014/0069257 | A1 * | 3/2014 | Hashimoto | 84/414 |
| 2014/0144309 | A1 * | 5/2014 | Cawthorne | 84/411 R |
| 2015/0059554 | A1 * | 3/2015 | Yoshino et al. | 84/414 |

FOREIGN PATENT DOCUMENTS

| | | | |
|---|---|---|---|
| JP | H07-117830 | B2 | 12/1995 |
| JP | 2001-142459 | A | 5/2001 |
| JP | 2002-169537 | A | 6/2002 |
| JP | 3656633 | B2 | 6/2005 |

OTHER PUBLICATIONS

Japanese Office Action dated Oct. 14, 2014 issued in corresponding Japanese Application JP 2012-201858 (partial English translation).

* cited by examiner

BASS DRUM

BACKGROUND OF THE INVENTION

1. Field of the Invention

The present invention relates to improvement in sound quality of a bass drum.

2. Description of the Related Art

A bass drum is played along with a tom-tom and a snare drum as a drum kit. For bass drum sounds, both powerful deep bass sound and attack sound brought about by a beater are needed. In order to get powerful deep bass sound, larger bass drums are used, or gel or a sponge ring are attached on a drumhead to emphasize deep bass sound. Such bass drums include a bass drum which has a vibration-absorbing member on a head member to vary bass drum sounds (for example, see Japanese Registered Utility Model No. 3004768). This drum is designed such that a drumhead is mounted on one opening end of a drum shell through a drum hoop while a vibration-absorbing member made of a thin rubber sheet or plastic is attached to the reverse side of the drumhead which is a striking surface.

SUMMARY OF THE INVENTION

As for the above-described drum having the vibration-absorbing member, however, because the vibration-absorbing member is attached to the entire surface of the drumhead, impaired movability of the drumhead increases to result in muffled sounds. There is a case in which a rubber sheet is used as the vibration-absorbing member. In a case where the entire surface of the vibration-absorbing member made of a rubber sheet is fixed to the drumhead, however, the drum can provide deep bass sound, but inflicts significant damage on the drumhead, so that the drum cannot generate sounds having clear attack. Without attack, therefore, bass drums fail to provide beat and to beat out a rhythm to degrade performances including performances of players of other musical instruments.

The present invention was accomplished to solve the above-described problem, and an object thereof is to provide a bass drum that can generate sounds having both deep bass sound and clear attack. As for descriptions for respective constituents of the present invention described below, numbers corresponding to components of later-described embodiments are given in parenthesis for easy understanding. However, the respective constituents of the present invention are not limited to the corresponding components indicated by the numbers of the embodiments.

In order to achieve the above-described object, it is a feature of the present invention to provide a bass drum (10, 20, 30, 40, 50, 60, 70, 80, 90, 100, 110) including a hollow cylindrical shell (11, 21, 61); a drumhead (12, 22, 72, 82, 92, 102, 112) mounted on one opening end of the shell to form a striking surface; and a striking surface attachment (13, 23, 73, 83, 93, 103, 113) which is formed of an elastic sheet to be placed on a reverse side of the drumhead and is fixed to the drumhead, wherein at least a part of an outer area of the striking surface attachment is fixed to the drumhead as a fixing portion and a central area of the striking surface attachment is not fixed to the drumhead.

In this case, for example, the striking surface attachment is placed over a surface of a movable part of the reverse side of the drumhead. It is preferable that the movable part is a useful movable part of the reverse side of the drumhead. The useful movable part is a portion which is a striking surface of the drumhead and excludes an invisible portion hidden by a hoop and the like. The central area of the striking surface attachment is an area close to the center of the striking surface attachment in a radial direction, while the outer area of the striking surface attachment is an area close to the outer rim of the striking surface attachment in the radial direction. Furthermore, it is preferable that the striking surface attachment is formed of a material having lower stiffness and higher specific gravity than a material of the drumhead. For instance, the striking surface attachment can be made of a different kind of rubber such as natural rubber, silicone rubber, or urethane rubber, or elastomer. The drumhead is formed of a PET (polyethylene terephthalate) film, for example. Furthermore, the width of the fixing portion in a radial direction may fall within a range from 5 mm to 50% of a radius of the drumhead. In the present invention, furthermore, the fixing by which the striking surface attachment is fixed to the drumhead may be adhesion, bonding or fixing by use of a fixing member such as rivets or staples of stapler.

The bass drum according to the present invention is designed such that the striking surface attachment is provided on the reverse side of the drumhead, wherein at least a part of the outer area of the striking surface attachment is fixed to the drumhead as the fixing portion without fixing the central area of the striking surface attachment to the drumhead. As a result, the bass drum according to the present invention is designed to efficiently lower frequencies of a struck sound to efficiently reinforce deep bass sound by increasing the mass of the drumhead by use of the striking surface attachment. According to the present invention, more specifically, by shifting sound volume to bass range, the bass drum of the present invention can generate struck sounds having deep bass sound.

As described above, furthermore, because only a part of the striking surface attachment is fixed to the drumhead, the drumhead and the striking surface attachment vibrate as a single unit as a whole in response to a strike on the bass drum, but separately behaves locally and instantly. Such behaviors realize both the reinforcement of deep bass sound and generation of struck sounds having clear attack. An experiment for measuring a time waveform exhibited at the time of a strike on the bass drum revealed that cycles of a struck sound brought about by the interaction between a beater and the drumhead in response to a strike on the drumhead with the beater are long, while an initial part of the waveform is a waveform having attack and high frequency sound supposed to be brought about by collision between the beater and the drumhead. Therefore, the experiment revealed that by the partial fixing portion by which the striking surface attachment is fixed to the drumhead, the bass drum according to the present invention can generate struck sounds having deep bass sound and clear attack, also providing struck sounds with brightness brought about by high frequency sound.

Furthermore, because the striking surface attachment is attached to the reverse side of the drumhead, the beater is not directly contact with the striking surface attachment. Therefore, strikes by the beater does not degrade durability of the striking surface attachment.

Furthermore, the fixing portion which is at least a part of the outer area of the striking surface attachment may be a whole circumference of the outer area of the striking surface attachment. Furthermore, the fixing portion may be formed of a plurality of parts situated on the outer area of the striking surface attachment to be away with each other with intervals being provided in a circumferential direction. Furthermore, the fixing portion may be formed of a plurality of parts scattered on the outer area of the striking surface attachment. However, it is preferable that a central portion which the beater hits is excluded from the fixing portion in order to prevent the striking surface attachment from producing ill effect on struck sounds. Without impairment of performance due to the striking surface attachment, as a result, the bass drum according to the present invention provides a player with sound quality and feeling of striking which are similar to the sound quality and the feeling provided by conventional bass drums.

Furthermore, the drumhead to which the striking surface attachment is attached and which is mounted on the shell may be replaceable. In this case, one of drumheads to which striking surface attachments each having a different fixing portion are attached, respectively, may be selectively attached to the shell. In other words, a plurality of assembled bodies each having a different fixing portion by which the striking surface attachment is fixed to the drumhead are prepared so that a player can choose a player's desired assembled body according to the player's purpose to mount the chosen body on the shell. Furthermore, the striking surface attachment which is attached to the drumhead may be replaceable. In this case, one of striking surface attachments each having a different fixing portion may be selectively fixed to the drumhead. In other words, by preparing different kinds of striking surface attachments having an adhesive agent or bonding adhesive on a part which is fixed to the drumhead, the player can choose a player's desired striking surface attachment according to the player's purpose to fix the selected striking surface attachment to the drumhead. As a result, modes of use of the bass drum are widely broadened.

It is another feature of the bass drum according to the present invention that the bass drum further includes a front head (26, 36, 46, 56) mounted on the other opening end of the shell (21, 61). Because of the provided front head, the bass drum can reinforce the deep bass sound.

It is still another feature of the bass drum according to the present invention that the front head (36) has an air vent (36*b*). Because of the air vent provided on the front head, struck sounds decay quickly. As a result, struck sounds of the bass drum become tight.

It is a further feature of the bass drum according to the present invention that the bass drum further includes a front surface attachment (43, 53) which is formed of an elastic sheet to be placed on at least either a front side or a reverse side of the front head (46, 56) and is fixed to the front head, wherein at least a part of the front surface attachment is fixed to the front head. In this case, for example, the front surface attachment is placed over a surface of a movable part of at least either a front side or a reverse side of the front head. It is preferable that the movable part is a useful movable part of at least either a front side or a reverse side of the front head.

The bass drum having the further feature can reinforce the deep bass sound even more. Because the front head is not a surface which the beater directly hits, the front surface attachment may be provided not on the reverse side but on the front side of the front head. Furthermore, because the front head does not have any interaction with the beater, the front surface attachment may be fixed by attaching the entire surface of the front surface attachment to the front head. However, the front surface attachment may be fixed by attaching only a part of the front surface attachment to the front head.

It is a still further feature of the bass drum according to the present invention that the front head (56) and the front surface attachment (53) have an air vent (56*b*). As for the bass drum having this feature, struck sounds decay quickly because of the air vent also provided on the front head to which the front surface attachment is attached. As a result, the struck sounds of the bass drum sound tight.

It is another feature of the bass drum according to the present invention that a sound-absorbing member (69) is placed on a part of an inner surface of the shell (61).

The bass drum having this feature can reduce internal resonance generated inside the shell. In this case, by providing the sound-absorbing member on the inner peripheral surface of the shell, the bass drum can reduce only the internal resonance generated inside the shell without a decrease in vibrations of the drumhead. This feature produces a great effect on a small bass drum. Because the inner volume of a shell of a small bass drum is small, the shell has internal resonance of higher frequencies. However, the bass drum having this feature can efficiently decrease the internal resonance. As the sound-absorbing member, urethane foam, sponge or the like can be used.

BRIEF DESCRIPTION OF THE DRAWINGS

FIG. 10(*c*) is a front view indicative of the main part of the front of the bass drum;

FIG. 11(*c*) is a front view indicative of the main part of the front of the bass drum;

12(*b*) is a section view; and FIG. 12(*c*) is a front view indicative of the main part of the front of the bass drum;

FIG. 13(*c*) is a front view indicative of the main part of the front of the bass drum;

FIG. 14(*c*) is a front view indicative of the main part of the front of the bass drum;

DESCRIPTION OF THE PREFERRED EMBODIMENT (First Embodiment)

Figure 1:
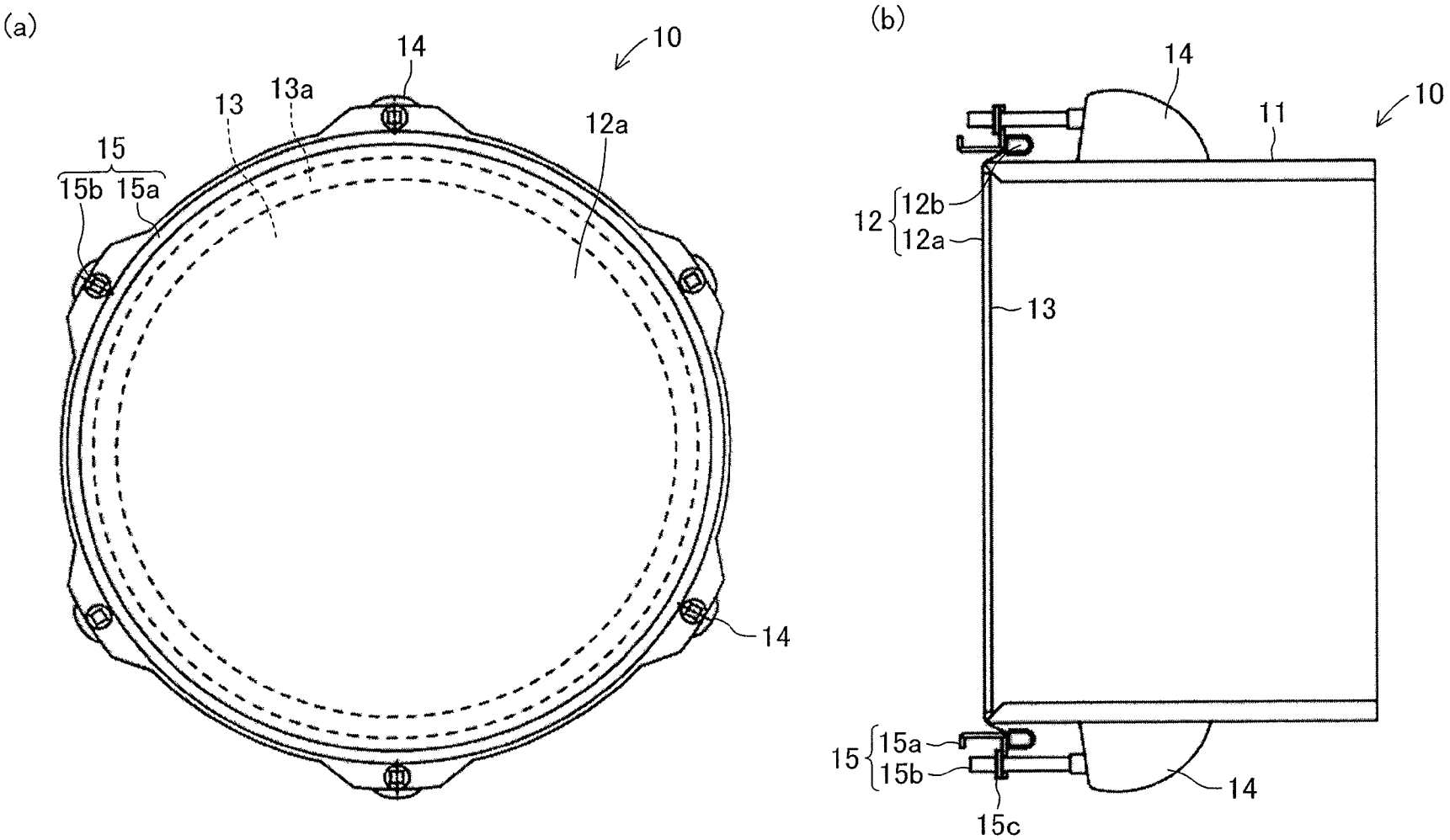
FIG. 1 shows a bass drum according to the first embodiment of the present invention, and more specifically, FIG. 1(*a*) is a rear view, and FIG. 1(*b*) is a section view of the bass drum.

A bass drum according to the first embodiment of the present invention will now be described with reference to the drawings. FIGS. 1 (*a*) and (*b*) show a bass drum 10 according to the embodiment. In the following explanation on the bass drum 10, the side facing audience is defined as the front (forward), while the side facing a player of the bass drum is defined as the back (rear). The bass drum 10 is designed to have a diameter of 12 inches with a depth of 11 inches. The bass drum 10 has a hollow cylindrical shell 11 which is a drum shell, and a circular drumhead 12 mounted on the rear opening end of the shell 11. To the reverse side (inner surface) of the drumhead 12, furthermore, a striking surface attachment 13 (a struck head mass-adding member 13) is attached. Basically, the mass of the striking surface attachment 13 reduces volume of sounds generated by the bass drum 10 by suppressing vibrations of the drum head 12.

Figure 2:
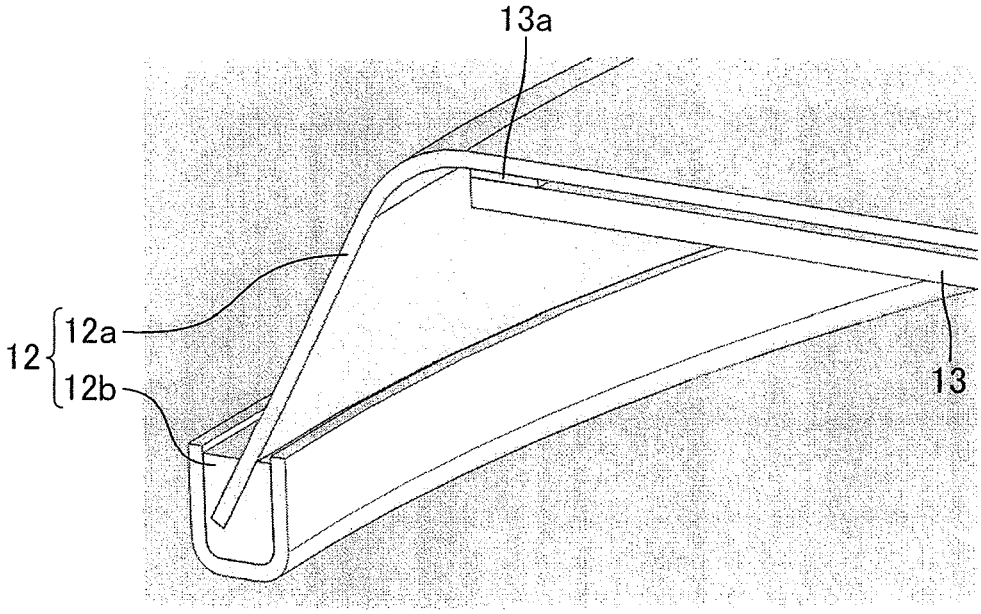
FIG. 2 is a partly notched perspective view indicative of a section of a fixing portion by which a striking surface attachment is fixed to a drumhead.

The shell 11 is made of wood (birch), and has functions of efficiently conveying internal air frontward and resonating the vibrations inside the shell 11 when vibrations occur. The drumhead 12 is formed of a circular head portion 12*a* made of a PET (polyethylene terephthalate) film and a flesh hoop 12*b* which is a metal ring. As indicated in FIG. 2, the head portion 12*a* is kept circular by connecting the outer edge of the head portion 12*a* with the flesh hoop 12*b*. The head portion 12*a* has a thickness of 250 μm, and has a diameter slightly larger than the diameter of the rear opening end of the shell 11.

Figure 3:
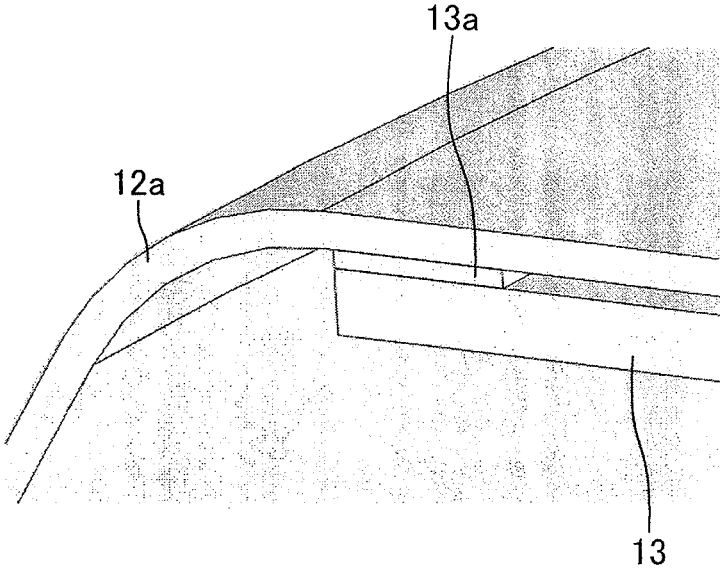
FIG. 3 is a partly notched perspective view indicative of the fixing portion by which the striking surface attachment is fixed to the drumhead with a double-faced tape.

The striking surface attachment 13 is a circular nitrile rubber sheet having a thickness of 1 mm, a diameter of 290 mm, and Shore hardness 50. The striking surface attachment 13 is made of material having lower stiffness and higher specific gravity than the drumhead 12. As indicated in FIG. 3, furthermore, the striking surface attachment 13 is placed on the reverse side of the head portion 12*a* so that a whole circumference of an outer area of the striking surface attachment 13 can be fastened to the head portion 12*a* by a double-faced tape 13*a* formed of acrylic pressure-sensitive adhesive and non-woven fabric. The width for which the striking surface attachment 13 is fixed to the head portion 12*a* (the width of the double-faced tape 13*a*) is 10 mm. The striking surface attachment 13 ranges all over a later-described useful movable part of the reverse side of the head portion 12*a*. A central area of the striking surface attachment 13 is not fixed to the head portion 12*a*. The central area of the striking surface attachment 13 indicates an area which is close to the center in a radial direction of the striking surface attachment 13, while the outer area indicates an area which is close to the outer rim in the radial direction of the striking surface attachment 13.

The drumhead 12 to which the striking surface attachment 13 is attached is mounted on the rear opening end of the shell 11 by lugs 14 and a stretching portion 15 so that the drumhead 12 can be detached. The drumhead 12 is formed to have a part in which the head portion 12*a* and the striking surface attachment 13 overlap each other to form a striking surface (a struck head) which a player hits. The internal diameter of the flesh hoop 12*b* is slightly larger than the outer diameter of the shell 11, so that when the rear portion of the shell 11 is placed within the flesh hoop 12*b*, the outer area of the head portion 12*a* and the outer edge of the striking surface attachment 13 are pressed against the rear opening end edge of the shell 11. The striking surface attachment 13 is situated at a part corresponding to the rear opening end of the shell 11, while the part situated on the head portion 12*a* corresponding to the rear opening end of the shell 11 is the useful movable part according to the present invention.

Each lug 14 is a member which gradually tapers from the flat rear surface to the front, and has a screw hole internally extending from the rear surface toward the front in parallel to the outer peripheral surface of the shell 11. The inner surface of the lugs 14 is curved along the outer peripheral surface of the shell 11, so that the lugs 14 are fastened along the outer peripheral surface of the shell 11 to be situated at slightly behind the center in the front-back direction of the outer peripheral surface of the shell 11. There are six lugs 14 provided along the circumferential direction of the shell 11 at regular intervals.

The stretching portion 15 is formed of a hoop 15*a* and tuning pins 15*b*. The hoop 15*a* is shaped like a stepwise ring whose diameter is larger in a front portion of the hoop 15*a* than in a rear portion. More specifically, the hoop 15*a* is designed such that the outer peripheral surface and the rear surface of the flesh hoop 12*b* are covered with the front portion of the hoop 15*a*, and the internal diameter of the rear portion is approximately the same as the internal diameter of the flesh hoop 12*b*. At an outer rear portion of the larger front portion of the hoop 15*a*, engaging projections 15*c* each having a pin-inserting hole are provided, so that as many engaging projections 15*c* as the lugs 14 are provided around the hoop 15*a* at regular intervals. Each tuning pin 15*b* is formed of a thread portion which can be inserted into the pin-inserting hole of the engaging projection 15*c* and can be engaged in the screw hole of the lug 14, and a head portion whose diameter is larger than the diameter of the pin-inserting hole of the engaging projection 15*c* so that the head portion cannot be inserted in the pin-inserting hole of the engaging projection 15*c*. Therefore, the bass drum 10 is provided with as many tuning pins 15*b* as the lugs 14.

Therefore, the drumhead 12 can be fixed to the shell 11 by mounting the drumhead 12 to which the striking surface attachment 13 is attached on the rear opening end of the shell 11 so that in a state where the engaging projections 15*c* face the lugs 14, respectively, the hoop 15*a* will be aligned with the rear part of the flesh hoop 12*b* to insert the thread portions of the respective tuning pins 15*b* into the pin-inserting holes of the engaging projections 15*c* to engage the thread portions in the screw holes of the lugs 14. By adjusting the tightness of the tuning pins 15*b*, the tension of the drumhead 12 and the striking surface attachment 13 can be adjusted. In this case, the rear portion of the hoop 15*a* protrudes behind the drumhead 12. Behind the drumhead 12, furthermore, a foot pedal having a beater which is not shown is provided. By player's manipulation of the foot pedal with a player's foot, the beater strikes the drumhead 12.

When the drumhead 12 of the bass drum 10 configured as above is hit with the beater, the drumhead 12 is displaced along with the striking surface attachment 13. In this case, the drumhead 12 and the striking surface attachment 13 vibrate as a single unit as a whole. However, tension is exerted individually on the drumhead 12 and the striking surface attachment 13, so that the drumhead 12 and the striking surface attachment 13 separately behave locally and instantly. By the displacement of the drumhead 12 and the striking surface attachment 13, furthermore, the air within the shell 11 is compressed to move forward. Then, the deformation of the drumhead 12 and the striking surface attachment 13 is repeated to result in vibrations, so that vibrations of air produced by the vibrations resonate as a struck sound.

Figure 4:
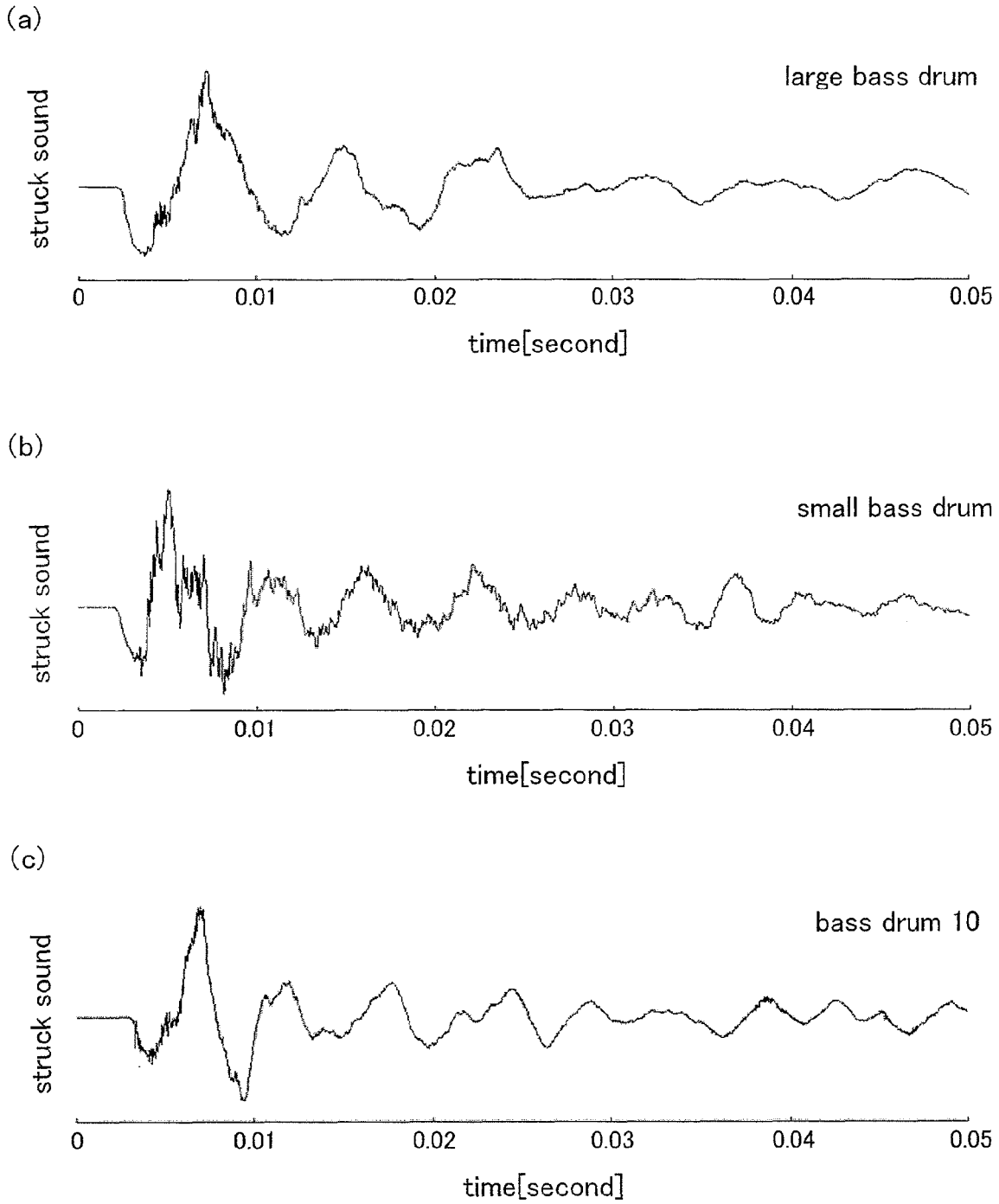
FIG. 4 indicates graphs representative of the magnitude of struck sounds with respect to elapsed time from a strike, and more specifically, FIG. 4(*a*) shows a waveform of a struck sound of a large bass drum, FIG. 4(*b*) shows a waveform of a struck sound of a small bass drum, and FIG. 4(*c*) shows a waveform of a struck sound of the bass drum of the first embodiment.

Because of the existence of the striking surface attachment 13, the bass drum 10 generates struck sounds having cycles and frequencies that are different from cycles and frequencies of struck sounds of conventional bass drums. An experiment in which a struck sound of the bass drum 10 and struck sounds of a conventional large bass drum and a conventional small bass drum were measured and compared with each other was carried out. The measured results are shown in FIGS. 4(*a*) to (*c*). FIGS. 4(*a*) to (*c*) show waveforms representative of changes in the magnitude of struck sounds with respect to elapsed time. FIG. 4(*a*) shows a waveform of a struck sound of the large bass drum, FIG. 4(*b*) shows a waveform of a struck sound of the small bass drum, and FIG. 4(*c*) shows a waveform of a struck sound of the bass drum 10.

As the large bass drum, a 22-inch bass drum having a diameter of 22 inches and a depth of 21 inches is used. The large bass drum is designed such that a drumhead formed by overlaying two PET films each having a thickness of 175 μm is attached to the rear opening end of a shell made of birch, with a front head formed of a PET film having a thickness of 250 μm being attached to the front opening end of the shell. At a position displaced by 125 mm from the center of the front head, furthermore, an air hole having a diameter of 160 mm is provided. In addition, a blanket is inserted into the shell so that the blanket will be contact with the drumhead and the front head to mute struck sounds.

As the small bass drum, a bass drum obtained by eliminating the striking surface attachment 13 from the bass drum 10 is used. In other words, the small bass drum is configured similarly to the bass drum 10 except the absence of the striking surface attachment 13. As for the striking of the drums, an identical player struck the respective bass drums by use of an identical foot pedal to play the drums moderately loud (mezzo forte). By a microphone for measurement placed near a player's ear, struck sounds were collected to compare analyzed results of time waveforms and frequency waveforms.

The experiment revealed, as indicated in a time waveform of FIG. 4(*a*), that the large drum generated a struck sound having long cycles, with the attack and high frequency sound being generated at the initial part of the waveform. This can be judged from vertical small serrations situated at the lower part and the upper part of an ascending slope of the first peak of the waveform and the position of the peak. The generation of the attack and the high frequency sound is brought about by the interaction between the beater and the drumhead. The struck sound of the large bass drum of this case is almost ideal as a bass drum sound.

The experiment also revealed that the waveform of the struck sound of the small bass drum indicated in FIG. 4(*b*) has shorter cycles and excessive harmonics which persist for a long period of time to have a serrated shape as a whole. This causes lack of deep bass sound and uncomfortable harmonics. As a result, the sound of the small bass drum does not sound favorably as a bass drum.

As indicated in FIG. 4(*c*), the waveform of the struck sound of the bass drum 10 is closely analogous to the waveform of the struck sound of the large bass drum. Compared with the waveform of the struck sound of the small bass drum, the experiment revealed that the waveform of the struck sound of the bass drum 10 has long cycles, with the attack and high frequency sound being generated at the initial part of the waveform. Furthermore, no excessive harmonics are generated in the waveform of the struck sound of the bass drum 10. These results reveal that by providing the small bass drum with the striking surface attachment 13, the bass drum can generate struck sounds similar to struck sounds generated by the large bass drum which generates ideal struck sounds by providing the front head with the air hole and using a blanket.

Figure 5:
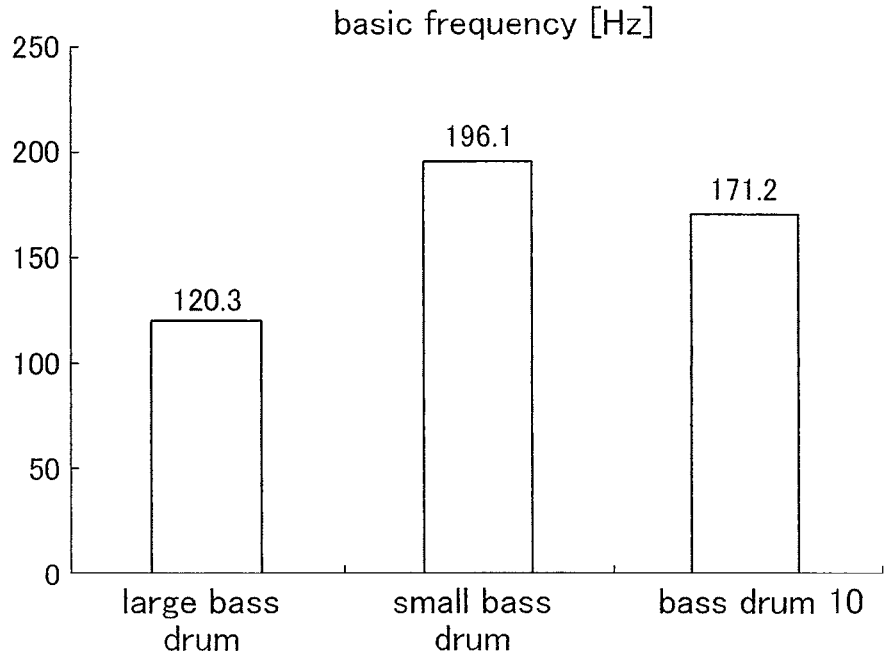
FIG. 5 is a graph comparing basic frequencies of the large bass drum, small bass drum and the bass drum of the first embodiment.

FIG. 5 indicates results of comparison of vibrational frequency of struck sounds of the above-described large bass drum, small bass drum and bass drum 10 brought about by interaction between the drumhead and the beater. The vibrational frequency is not a resonance frequency of pure free vibration of the drumhead, but is a basic frequency of mutual vibrational frequencies determined according to inertial moment and torque of the beater manipulated by a player's foot, and the mass and tension of the useful movable part of the drumhead. As indicated in FIG. 5, the basic frequency of the large bass drum is 120.3 Hz, the basic frequency of the small bass drum is 196.1 Hz, and the basic frequency of the bass drum 10 is 171.2 Hz.

Figure 6:
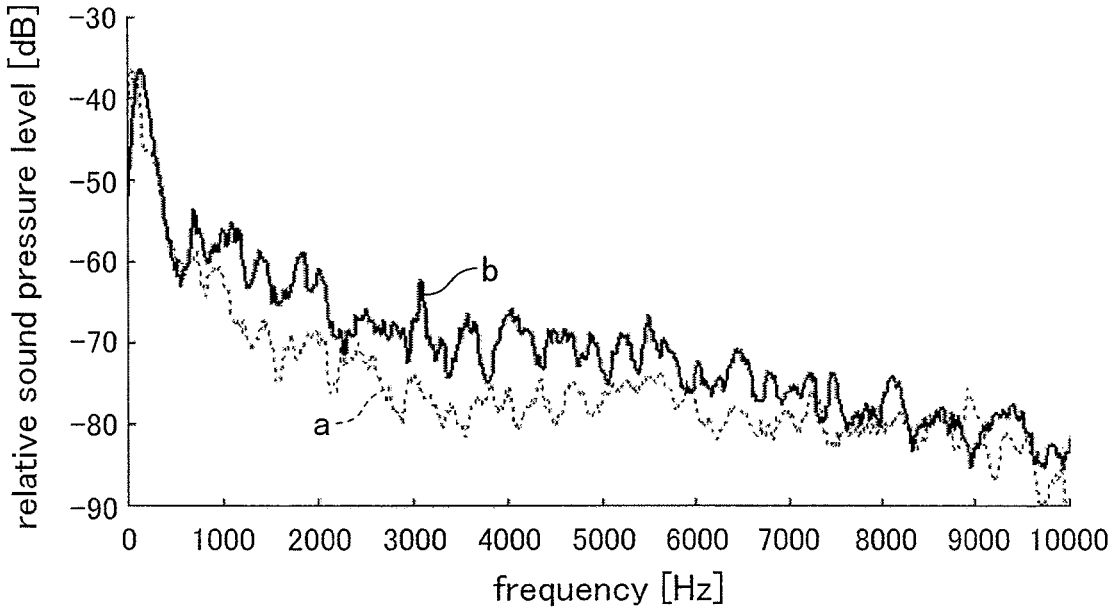
FIG. 6 is a graph comparing the magnitude of sound pressure of struck sounds of the large bass drum and small bass drum with respect to frequency.
Figure 7:
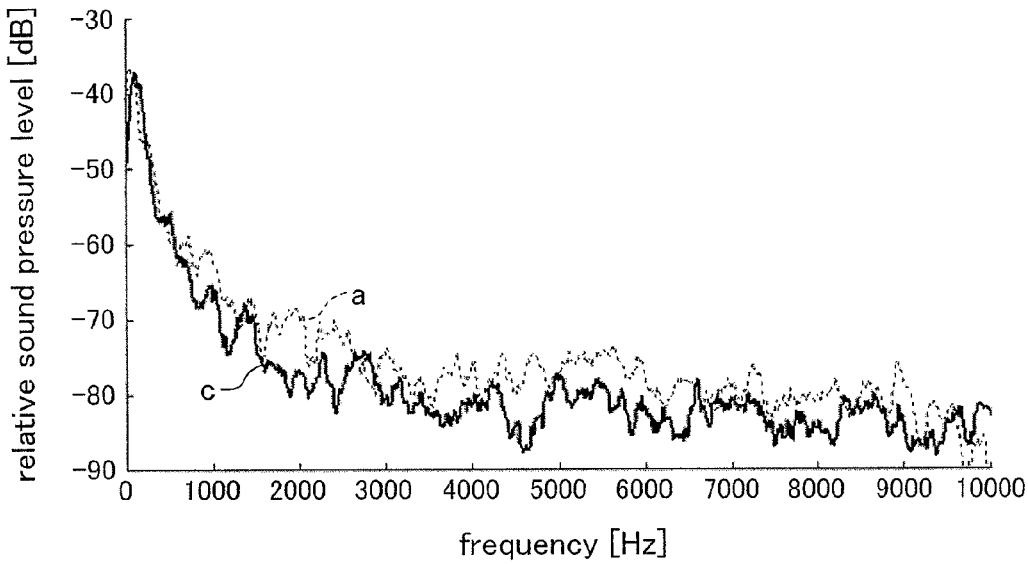
FIG. 7 is a graph comparing the magnitude of sound pressure of struck sounds of the large bass drum and the bass drum of the first embodiment with respect to frequency.

FIG. 6 and FIG. 7 indicate results of observation in frequency domain of the above-described struck sounds of the large bass drum, the small bass drum and the bass drum 10. FIG. 6 indicates results of frequency analysis of the struck sounds of the large bass drum and the small bass drum. A broken line "a" of FIG. 6 represents the struck sound of the large bass drum, while a solid line "b" represents the struck sound of the small bass drum. As for the broken line "a", the first peak corresponds to 120.3 Hz which is the basic frequency of the large bass drum indicated in FIG. 5. As for the solid line "b", the first peak corresponds to 196.1 Hz which is the basic frequency of the small bass drum indicated in FIG. 5.

In comparison between the broken line "a" and the solid line "b" of FIG. 6, the solid line "b" has frequency components which are higher than frequency components of the broken line "a" almost in the whole band of 1000 Hz to 7000 Hz. This means that, compared with the struck sound of the large bass drum, the struck sound of the small bass drum does not have bass sound which are deep enough, but has many components having uncomfortable harmonics.

FIG. 7 indicates results of frequency analysis of the struck sounds of the large bass drum and the bass drum 10. A broken line "a" of FIG. 7 represents the struck sound of the large bass drum, while a solid line "c" represents the struck sound of the bass drum 10. The broken line "a" indicated in FIG. 6 is the same one as the broken line "a" indicated in FIG. 7. As for the solid line "c", the first peak corresponds to 171.2 Hz which is the basic frequency of the bass drum 10 indicated in FIG. 5. In comparison between the broken line "a" and the solid line "c" of FIG. 7, peaks in low frequencies on the solid line "c" are similar to those of the broken line "a", and have no excessive harmonics. This means that the struck sound of the bass drum 10 is closely analogous to the struck sound of the large bass drum.

Furthermore, the same experiment as the above-described experiment was carried out on the struck sound of the bass drum 10 and a bass drum according to a comparison example. The bass drum according to the comparison example is obtained by attaching a rubber sheet which is identical with the striking surface attachment 13 to the reverse side of a drum head of a bass drum which is identical with the above-described conventional small bass drum so that the entire rubber sheet will be fastened to the reverse side of the drumhead by use of acrylic pressure-sensitive adhesive layer which is identical with the double-faced tape 13*a*. In other words, the bass drum according to the comparison example is identical with the bass drum 10 if the entire surface of the striking surface attachment 13 were fastened to the drum head 12. More specifically, the bass drum according to the comparison example is equivalent to the drum described in Description of the Related Art.

Figure 8:
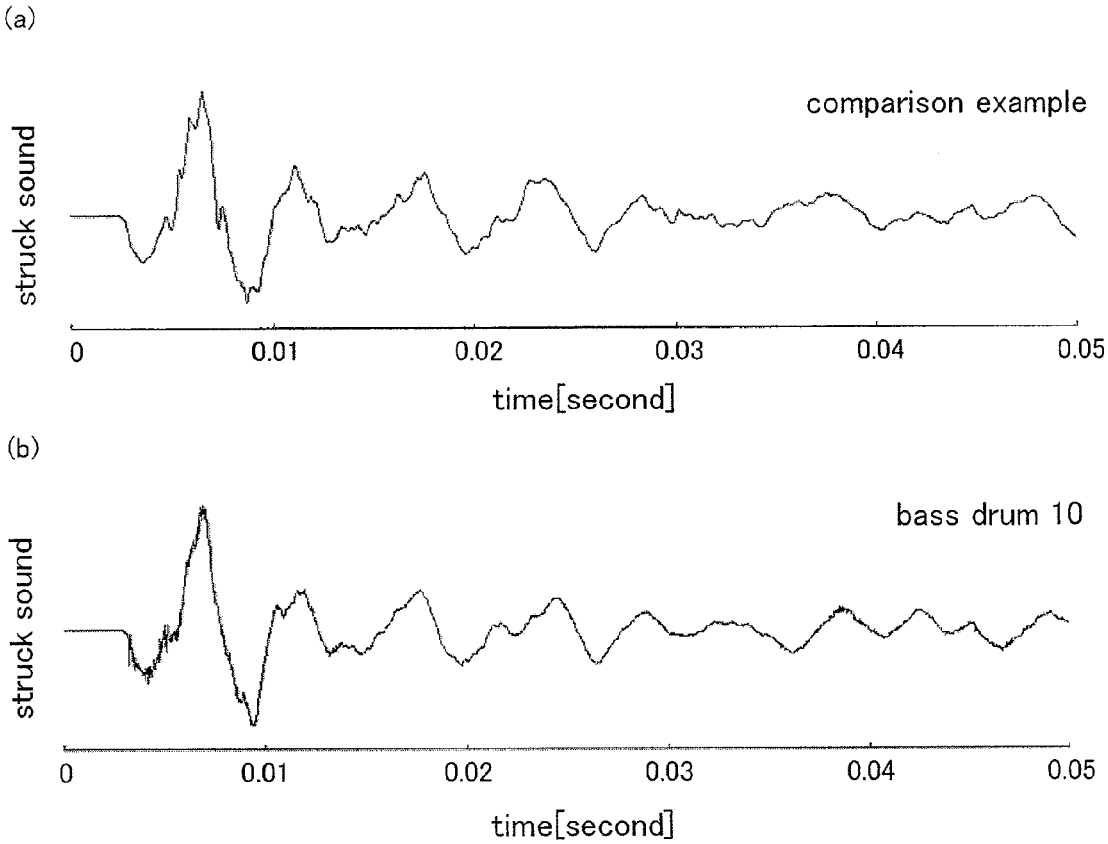
FIG. 8 indicates graphs representative of the magnitude of sound pressure with respect to elapsed time from a strike, and more specifically, FIG. 8(*a*) shows a waveform of a struck sound of a bass drum of a comparison example, and FIG. 8(*b*) shows a waveform of a struck sound of the bass drum of the first embodiment.

The measured results of these drums are shown in FIGS. 8(*a*) and (*b*). FIGS. 8(*a*) and (*b*) show waveforms representative of changes in the magnitude of struck sounds with respect to elapsed time. FIG. 8(*a*) shows a waveform of a struck sound of the bass drum according to the comparison example, and FIG. 8(*b*) shows a waveform of a struck sound of the bass drum 10. The waveform shown in FIG. 8(*b*) is identical with the waveform shown in FIG. 4(*c*).

The experiment revealed that as for the bass drum according to the comparison example shown in FIG. 8(*a*), the entirely fastened rubber sheet contributes lowered frequencies of the struck sound and energy-shift to low frequencies, whereas the rubber sheet whose entire surface is fastened to the drumhead causes abrupt increase in material loss of the drumhead to cause absence of attack and harmonics. The cycles of FIG. 8(*a*) are longer than the cycles of the small bass drum. The absence of attack and harmonics can be judged because an ascending slope of the first peak of the waveform hardly has small vertical serrations. The bass drum of the comparison example generates a muffled sound.

The waveform of the struck sound of the bass drum 10 indicated in FIG. 8(*b*) revealed, as described above, that the bass drum 10 can generate struck sounds having attack and harmonics. This is because the bass drum 10 is designed such that the drumhead 12 is separated from the striking surface attachment 13 at the central area, so that the collision of the beater with the drumhead 12 initially behaves similarly to the collision with the drumhead of the large bass drum. Therefore, because of the colliding sound between the beater and the drumhead 12, the bass drum 10 can reproduce a struck sound having attack.

As for behavior in high frequencies such as harmonics, furthermore, because the drumhead 12 and the striking surface attachment 13 behave separately to some extent, the bass drum 10 does not lose all the harmonics that the drumhead of the large bass drum can generate, but can generate struck sounds having brightness. As a secondary action, because the striking surface attachment 13 is fastened to the drum head 12 only by the outer area, a phenomenon in which the drumhead 12 collides with the striking surface attachment 13 occurs. By the two effects of the collision phenomenon between the beater and the drumhead 12 and the collision phenomenon between the drumhead 12 and the striking surface attachment 13, the bass drum 10 can generate struck sounds having both deep bass sound and attack.

Figure 9:
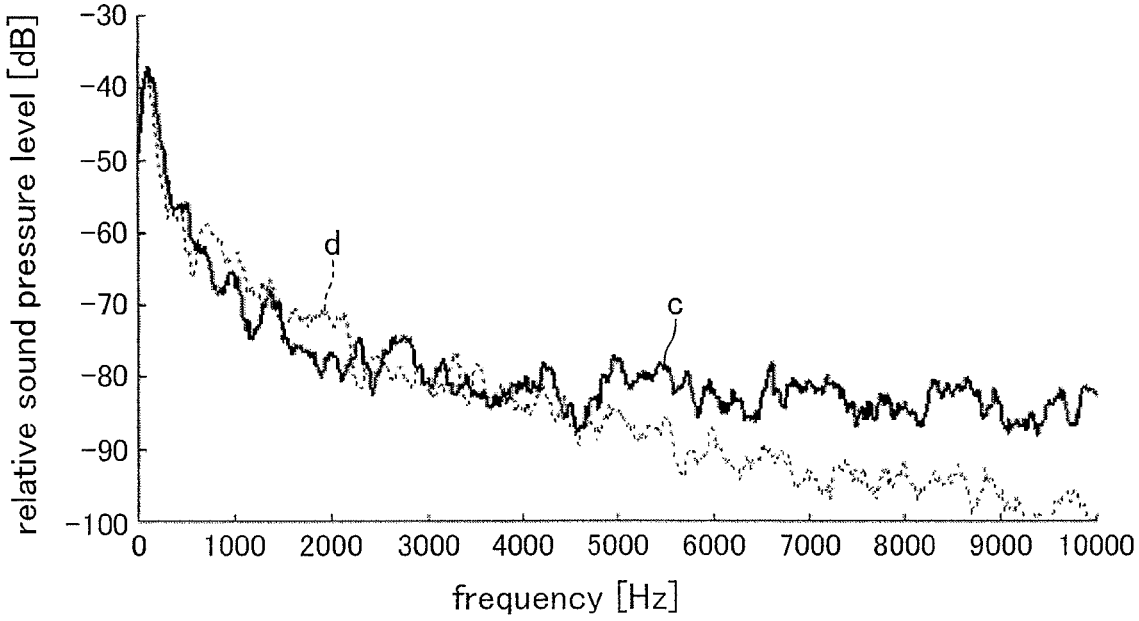
FIG. 9 is a graph comparing the magnitude of sound pressure of struck sounds of the bass drum of the comparison example and the bass drum of the first embodiment with respect to frequency.

FIG. 9 indicates results of observation in frequency domain of the struck sounds of the bass drum according to the comparison example and the bass drum 10. FIG. 9 indicates results of frequency analysis of the struck sounds of the bass drum according to the comparison example and the bass drum 10. A broken line "d" of FIG. 9 represents the struck sound of the bass drum according to the comparison example, while a solid line "c" represents the struck sound of the bass drum 10. The solid line "c" of FIG. 9 represents the same waveform as the solid line "c" of FIG. 7. In comparison between the broken line "d" and the solid line "c" of FIG. 9, when the frequency exceeds 5000 Hz, the broken line "d" has an abrupt decrease in harmonic components, compared to the solid line "c". This means that compared with the struck sound of the bass drum 10, the struck sound of the bass drum of the comparison example does not have attack.

As described above, the bass drum 10 according to the embodiment has the striking surface attachment 13 at the reverse side of the drumhead 12. More specifically, the outer area of the striking surface attachment 13 is fixed to the drumhead 12 with the double-faced tape 13*a*. By making the drumhead 12 heavy by use of the striking surface attachment 13, therefore, the bass drum 10 can efficiently lower the frequencies of struck sounds to efficiently reinforce the depth of the bass sound.

Furthermore, because only the outer area of the striking surface attachment 13 is fixed to the drumhead 12, the drumhead 12 and the striking surface attachment 13 vibrate as a single unit as a whole in response to a strike on the bass drum 10, but separately behaves locally and instantly. Such behaviors maintain a struck sound having both depth of bass sound and clear attack peculiar to bass drum. Furthermore, because the striking surface attachment 13 is attached to the reverse side of the drumhead 12, the beater is not contact directly with the striking surface attachment 13. Therefore, the strikes on the drumhead 12 with the beater does not decrease durability of the striking surface attachment 13.

(Second Embodiment)

Figure 10:
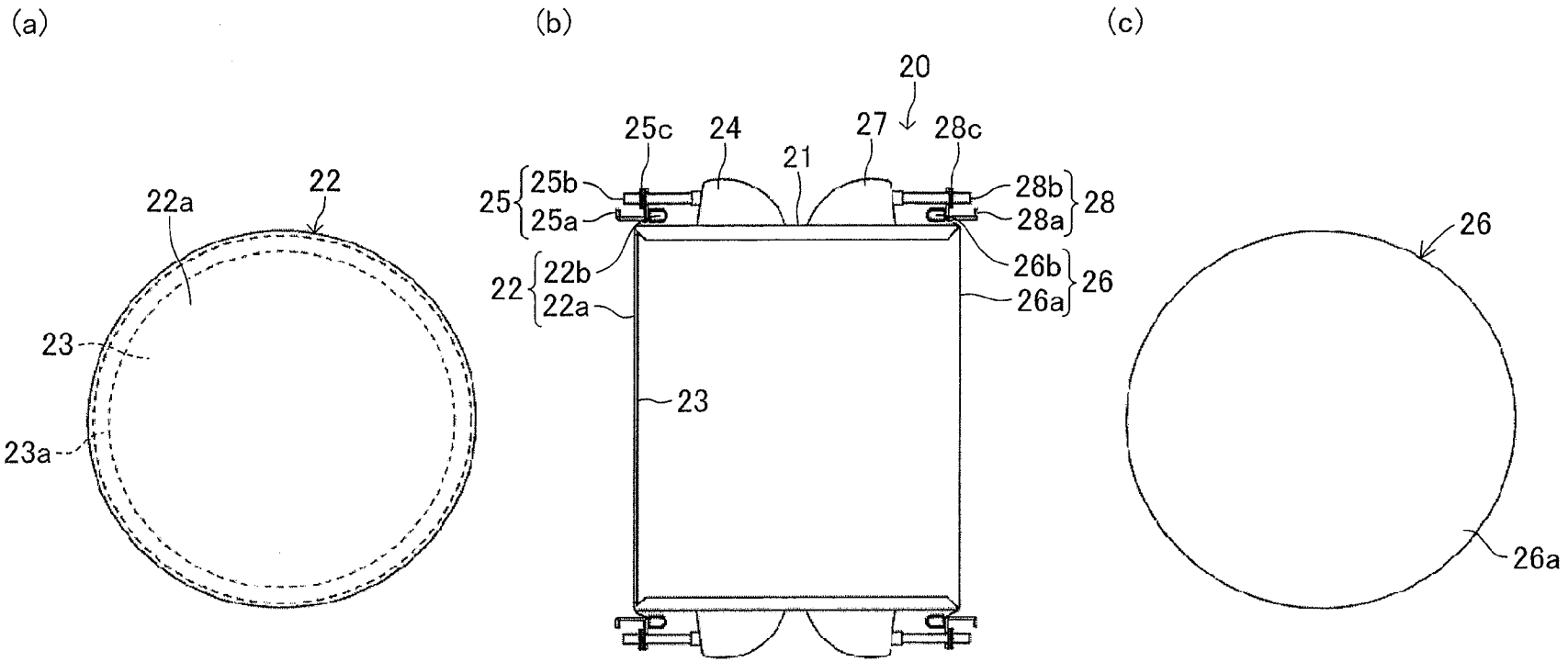
FIG. 10 shows a bass drum according to the second embodiment of the present invention, and more specifically, FIG. 10(*a*) is a rear view indicative of the main part of the rear, FIG. 10(*b*) is a section view.

FIGS. 10(*a*) to (*c*) indicate a bass drum 20 according to the second embodiment of the present invention. The bass drum 20 has a hollow cylindrical shell 21 which is a drum shell, a circular drumhead 22 mounted on the rear opening end of the shell 21, and a circular front head 26 mounted on the front opening end of the shell 21. The drumhead 22 is formed of a head portion 22*a* and a flesh hoop 22*b*. To the reverse side of the head portion 22*a*, a striking surface attachment 23 is attached with a double-faced tape 23*a*. The drumhead 22 is mounted on the rear opening end of the shell 21 with six lugs 24 provided on an outer peripheral surface of the shell 21 and a stretching portion 25 formed of a hoop 25*a* including engaging protrusions 25*c* and tuning pins 25*b*.

Among the above-described members, the shell 21, the drumhead 22, the striking surface attachment 23, the double-faced tape 23*a*, the lugs 24 and the stretching portion 25 are configured similarly to the shell 11, the drumhead 12, the striking surface attachment 13, the double-faced tape 13*a*, the lugs 14 and the stretching portion 15 of the above-described first embodiment. In other words, the bass drum 20 is identical with the bass drum 10 if the front head 26 were excluded from the bass drum 20. The front head 26 is formed of a circular head portion 26*a* made of the same PET film as the head portion 22*a* and a flesh hoop 26 made of the same metal ring as the flesh hoop 22*b*.

The front head 26 is mounted on the front opening end of the shell 21 through six lugs 27 and a stretching portion 28 so that the front head 26 can be attached/detached to/from the front opening end of the shell 21 by a manner similar to the drumhead 22 though the direction is switched back to front. In this case as well, thread portions of respective tuning pins 28*b* provided on the stretching portion 28 are inserted into pin-inserting holes of engaging projections 28*c* provided on the hoop 28*a* to engage the thread portions in screw holes of the lugs 27. By adjusting the tightness of the tuning pins 28*b*, the tension of the front head 26 can be adjusted. FIGS. 10(*a*) and (*c*) indicate the bass drum 20 without the lugs 24 and 27, and the stretching portions 25 and 28.

When the striking surface of the bass drum 20 configured as above is hit with the beater, the drumhead 22 is displaced along with the striking surface attachment 23. In this case, the drumhead 22 and the striking surface attachment 23 vibrate similarly to the above-described drumhead 12 and the striking surface attachment 13. By the displacement of the drumhead 22 and the striking surface attachment 23, furthermore, the air within the shell 21 is compressed, so that the compressed air presses the front head 26 forward to deform the front head 26. Then, the deformation of the drumhead 22, the striking surface attachment 23 and the front head 26 is repeated to result in vibrations, so that vibrations of air produced by the vibrations resonate as a struck sound. The depth of the resultant struck sound is reinforced, compared with the struck sound generated by the bass drum 10. The operational advantage of the bass drum 20 other than the above is the same as that of the bass drum 10.

(Third Embodiment)

Figure 11:
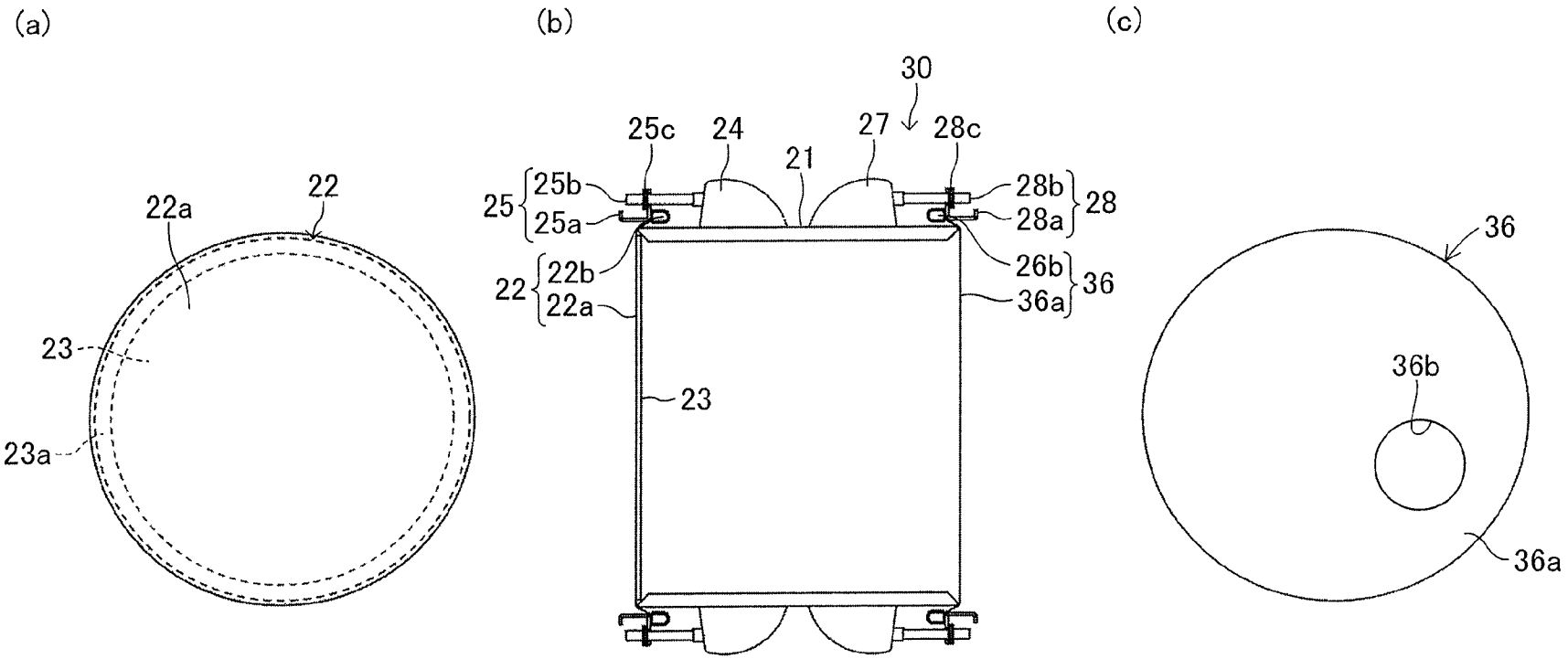
FIG. 11 shows a bass drum according to the third embodiment of the present invention, and more specifically, FIG. 11(*a*) is a rear view indicative of the main part of the rear, FIG. 11(*b*) is a section view.

FIGS. 11(*a*) to (*c*) indicate a bass drum 30 according to the third embodiment of the present invention. The bass drum 30 is designed such that a head portion 36*a* of a front head 36 has an air hole 36*b* which is an air vent according to the present invention. The air hole 36*b* is provided so that the air hole 36*b* will be away from the center of the head portion 36*a* by 56 mm, and will have a diameter of 100 mm. Except the air hole 36*b*, the bass drum 30 is configured similarly to the above-described bass drum 20. Therefore, similar components are given similar numerals to omit explanations of the components.

Because of the air hole 36*b* provided on the head portion 36*a*, the bass drum 30 allows the air within the shell to escape to the outside to speed up decay of struck sounds. As a result, the bass drum 30 can generate tighter sounds than struck sounds generated by the bass drum 20. The operational advantage of the bass drum 30 other than the above is the same as that of the bass drum 20 of the second embodiment.

(Fourth Embodiment)

Figure 12:
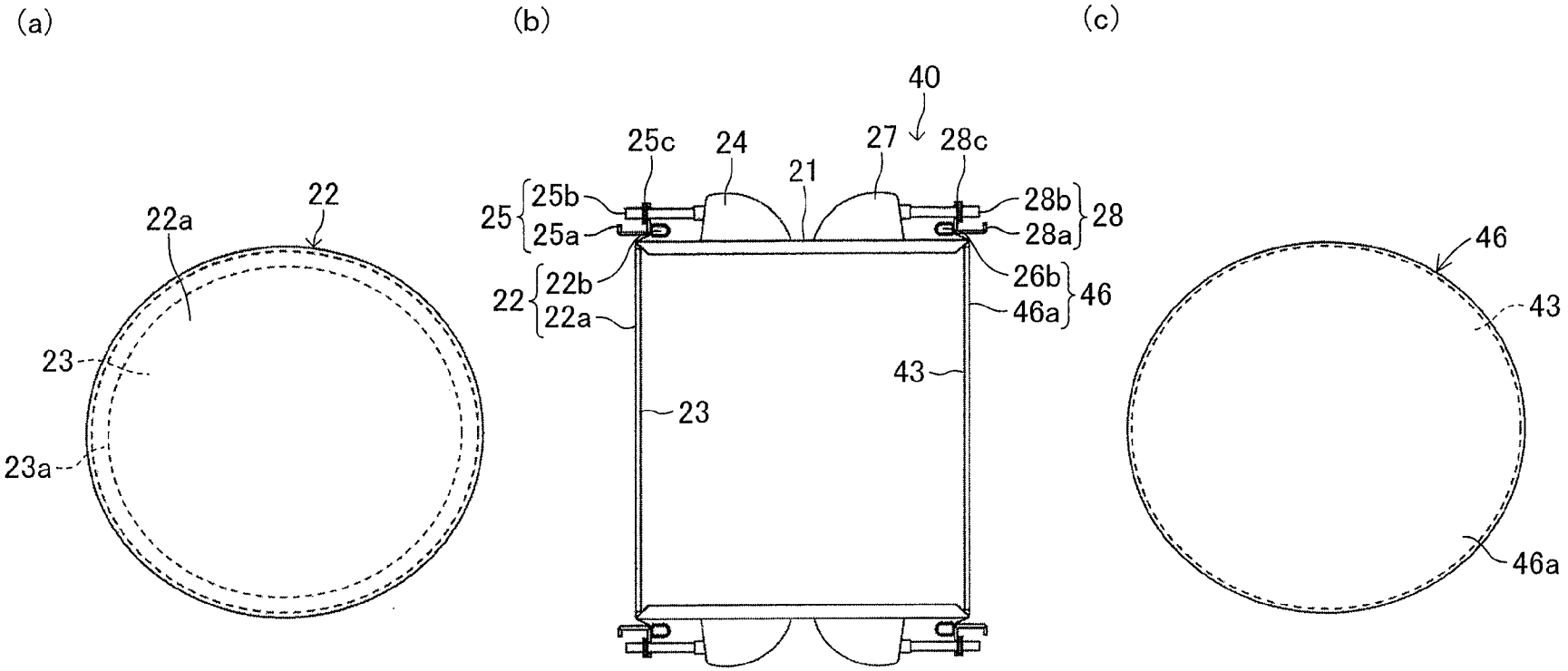
FIG. 12 shows a bass drum according to the fourth embodiment of the present invention, and more specifically, FIG. 12(*a*) is a rear view indicative of the main part of the rear, FIG.

FIGS. 12(*a*) to (*c*) indicate a bass drum 40 according to the fourth embodiment of the present invention. The bass drum 40 is designed such that a front surface attachment 43 (a front mass-adding member 43) is attached to the reverse side (inner surface) of a head portion 46*a* of a front head 46. The front surface attachment 43 is configured similarly to the above-described striking surface attachment 13, and is fixed to the front head 46 such that the entire surface of the front surface attachment 43 is fixed to the front head 46 with a double-faced tape. Except the front surface attachment 43, the bass drum 40 is configured similarly to the above-described bass drum 20. Therefore, similar components are given similar numerals to omit explanations of the components.

The bass drum 40 can reinforce the depth of bass sound more than the above-described bass drum 20. The operational advantage of the bass drum 40 other than the above is the same as that of the bass drum 20 of the second embodiment. Because the front head 46 is not a surface which the beater directly hits, the front surface attachment 43 may be provided not on the reverse side but on the front side of the front head 46. Furthermore, because the front head 46 does not have any interaction with the beater, the front surface attachment 43 may be fixed by attaching the entire surface of the front surface attachment 43 to the front head 46, as in the case of the bass drum 40. However, the front surface attachment 43 may be fixed by attaching only the outer area to the front head 46 as in the case of the striking surface attachment 23, or by attaching some parts of the front surface attachment 43 to the front head 46 randomly.

(Fifth Embodiment)

Figure 13:
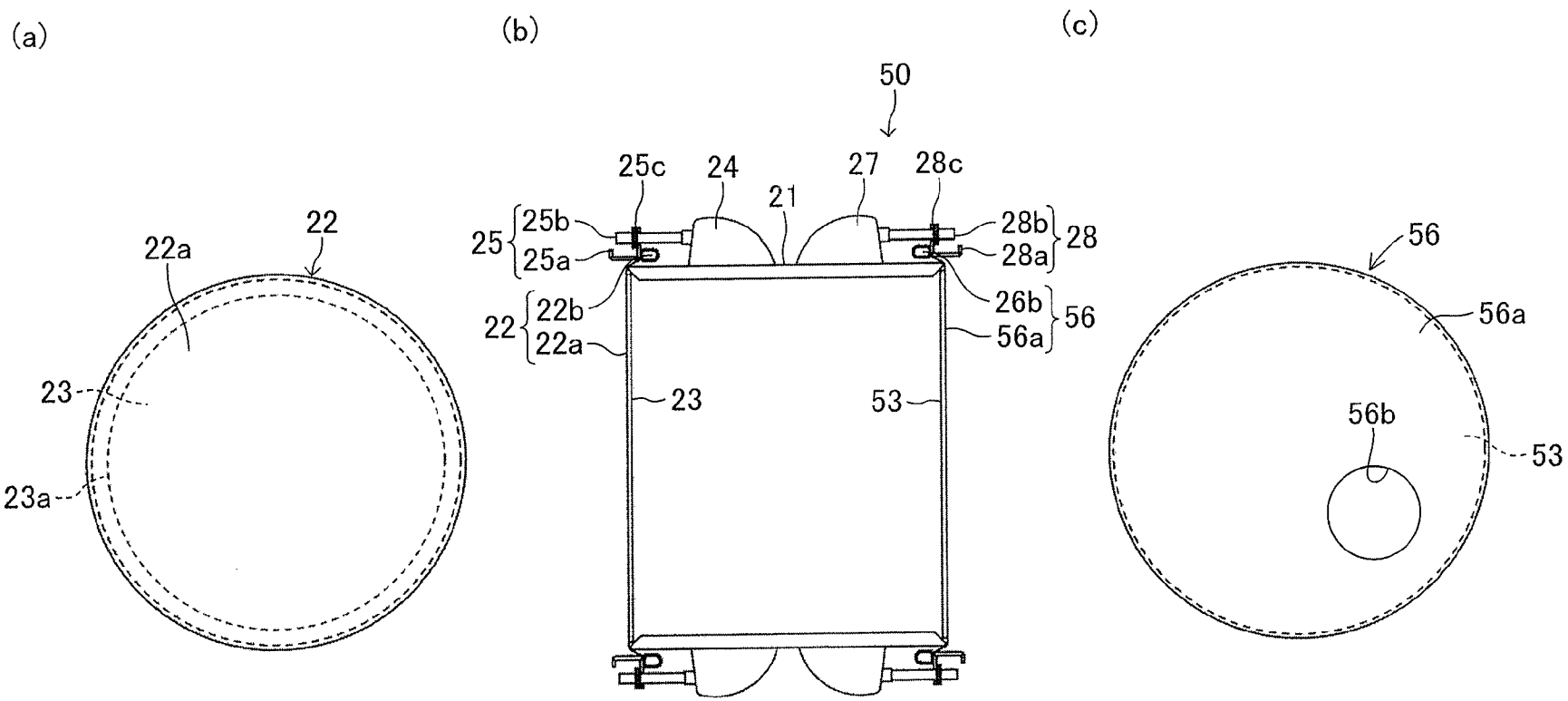
FIG. 13 shows a bass drum according to the fifth embodiment of the present invention, and more specifically, FIG. 13(*a*) is a rear view indicative of the main part of the rear, FIG. 13(*b*) is a section view.

FIGS. 13(*a*) to (*c*) indicate a bass drum 50 according to the fifth embodiment of the present invention. The bass drum 50 is designed such that a front surface attachment 53 is attached to the reverse side of a head portion 56*a* of a front head 56, while an air hole 56*b* is provided on the head portion 56*a* and the front surface attachment 53 so that the air hole 56*b* will pierce through the head portion 56*b* and the front surface attachment 53 from the front to the rear. The air hole 56*b* is provided so that the air hole 56*b* will be away from the center of the head portion 56*a* and the front surface attachment 53 by 56 mm, and will have a diameter of 100 mm. Except the air hole 56*b*, the bass drum 50 is configured similarly to the above-described bass drum 40. Therefore, similar components are given similar numerals to omit explanations of the components.

Because of the air hole 56*b* provided on the head portion 56*a* and the front surface attachment 53, the bass drum 50 allows the air within the shell to escape to the outside to speed up decay of struck sounds. As a result, the bass drum 50 can generate tighter sounds than struck sounds generated by the bass drum 40. The operational advantage of the bass drum 50 other than the above is the same as that of the bass drum 40 of the fourth embodiment. In this case as well, the front surface attachment 53 may be provided not on the reverse side but on the front side of the front head 56. Furthermore, the front surface attachment 53 may be fixed by attaching part of the front surface attachment 53 to the front head 56.

(Sixth Embodiment)

Figure 14:
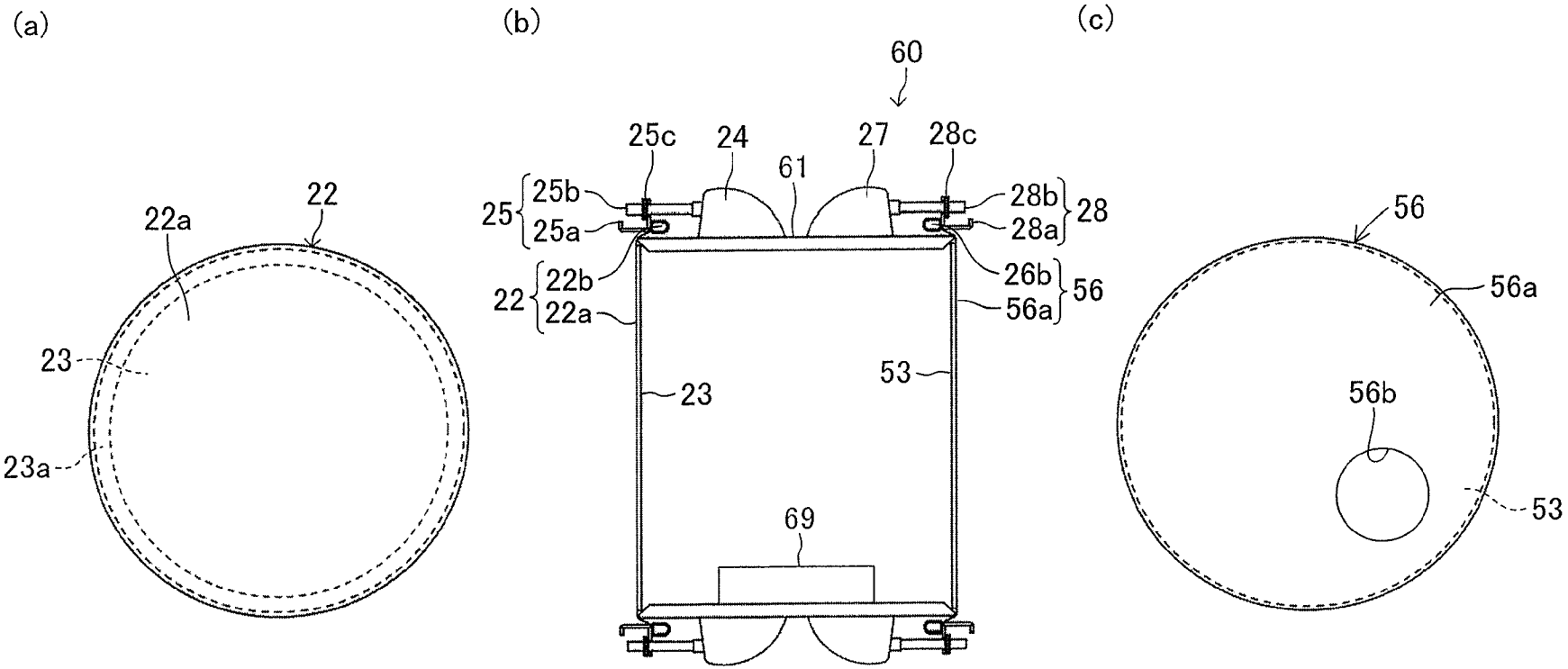
FIG. 14 shows a bass drum according to the sixth embodiment of the present invention, and more specifically, FIG. 14(*a*) is a rear view indicative of the main part of the rear, FIG. 14(*b*) is a section view.

FIGS. 14(*a*) to (*c*) indicate a bass drum 60 according to the sixth embodiment of the present invention. The bass drum 60 is designed such that a sound-absorbing member 69 is provided on a part (lower part) of an inner peripheral surface of a shell 61. The sound-absorbing member 69 is formed of urethane foam having a thickness of 40 mm, a length of 150 mm from the front to the rear, a length of 200 mm measured along a circumferential direction of the inner peripheral surface of the shell 61, and a density of 20 kg/m3. The sound-absorbing member 69 is attached at the center in a front-rear direction of the inner peripheral surface of the shell 61 with adhesive. Except the sound-absorbing member 69, the bass drum 60 is configured similarly to the above-described bass drum 50. Therefore, similar components are given similar numerals to omit explanations of the components.

The bass drum 60 can eliminate internal resonance generated inside the shell 61. As a result, the bass drum 60 can a generate comfortable struck sound. The operational advantage of the bass drum 60 other than the above is the same as that of the bass drum 50 of the fifth embodiment. In this case as well, the front surface attachment 53 may be provided not on the reverse side but on the front side of the front head 56. Furthermore, the front surface attachment 53 may be fixed by attaching part of the front surface attachment 53 to the front head 56.

Figure 15:
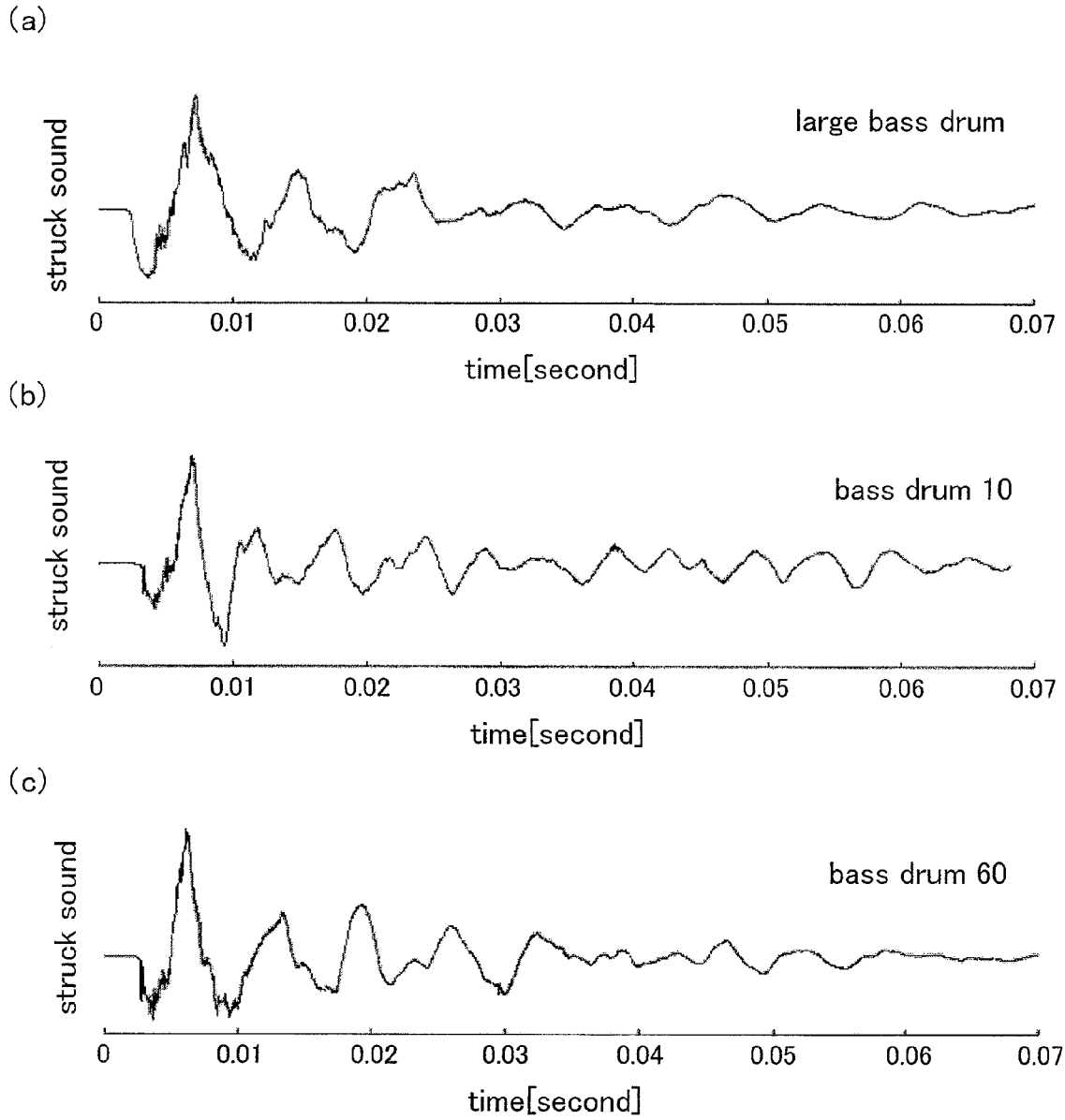
FIG. 15 indicates graphs representative of the magnitude of sound pressure with respect to elapsed time from a strike, and more specifically, FIG. 15(*a*) shows a waveform representative of a struck sound of the large bass drum, FIG. 15(*b*) shows a waveform representative of a struck sound of the bass drum of the first embodiment, and FIG. 15(*c*) shows a waveform representative of a struck sound of the bass drum of the sixth embodiment.

Furthermore, a test in which a struck sound of the bass drum 60 is compared with struck sounds of the above-described large bass drum and the bass drum 10 according to the first embodiment was carried out. Results of the test are shown in FIGS. 15(*a*) to (*c*). FIGS. 15(*a*) to (*c*) indicate waveforms representative of changes in the magnitude of struck sounds with respect to elapsed time. FIG. 15(*a*) shows a waveform of a struck sound of the large bass drum, FIG. 15(*b*) shows a waveform of a struck sound of the bass drum 10, and FIG. 15(*c*) shows a waveform of a struck sound of the bass drum 60. Although the waveform shown in FIG. 15(*a*) is identical with the waveform shown in FIG. 4(*a*), and the waveform shown in FIG. 15(*b*) is identical with the waveform shown in FIG. 4(*c*) and FIG. 8(*b*), the waveform appears in FIG. 15 again for easy comparison.

Compared with the waveform of the bass drum 10 shown in FIG. 15(*b*), the waveform of the bass drum 60 shown in FIG. 15(*c*) indicates that the frequencies mutually acted by the beater and the drumhead 22 are profoundly low. Therefore, the test revealed that the bass drum 60 can generate a struck sound which is deeper than the struck sound of the bass drum 10. The effect brought about by the interaction between the beater and the drumhead 22 is enhanced by the front surface attachment 53 attached to the front head 56.

Furthermore, the bass drum 60 generates a struck sound, also emphasizing the initial attack and harmonics. This is because the striking surface attachment 23 is partially fixed to the head portion 22*a* (only on the outer area) of the drumhead 22 similarly to the bass drum 10. Compared with the large bass drum and the bass drum 10, furthermore, a struck sound decays fast on the bass drum 60. More specifically, a sustained sound of a struck sound disappears in the order of 0.06 second on the bass drum 60. As a result, it can be understood that the bass drum 60 can generate tight sounds that bass drums are generally expected to generate. The generation of the tight sound is brought about by the air hole 56*b* provided on the head portion 56*a* and the front surface attachment 53, and the sound-absorbing member 69 provided on the shell 61.

Figure 16:
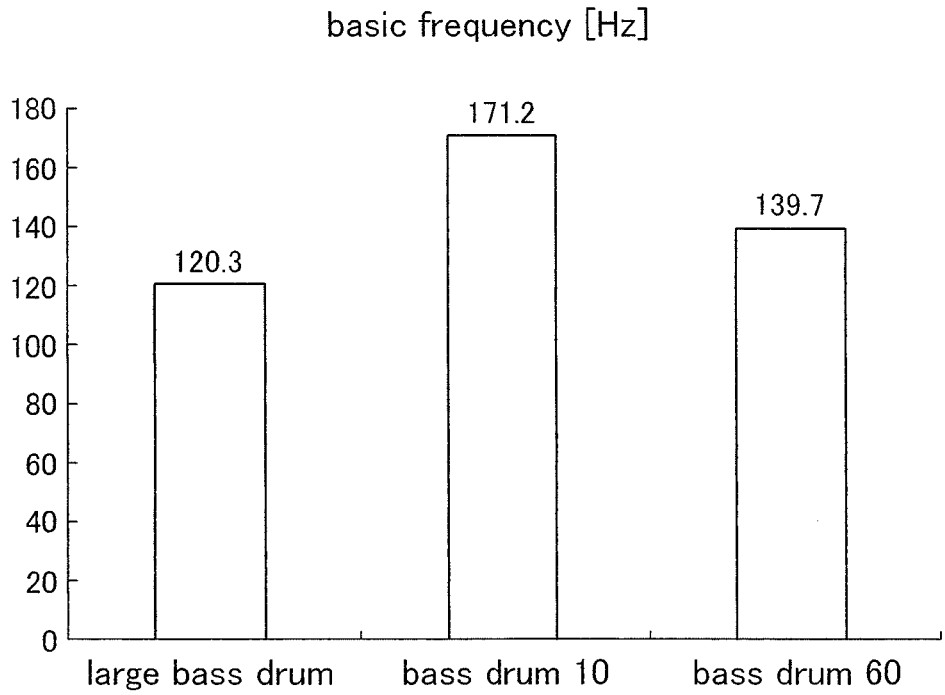
FIG. 16 is a graph comparing basic frequencies of the large bass drum, the bass drum of the first embodiment and the bass drum of the sixth embodiment.

FIG. 16 indicates results of comparison of vibrational frequency of struck sounds of the large bass drum, the bass drum 10 and the bass drum 60 brought about by interaction between the drumhead and the beater. As indicated in FIG. 16, the basic frequency of the large bass drum is 120.3 Hz, the basic frequency of the bass drum 10 is 171.2 Hz, and the basic frequency of the bass drum 60 is 139.7 Hz. Although FIG. 16 has overlaps with FIG. 5, FIG. 16 shows the overlaps for easy comparison among different combinations.

Figure 17:
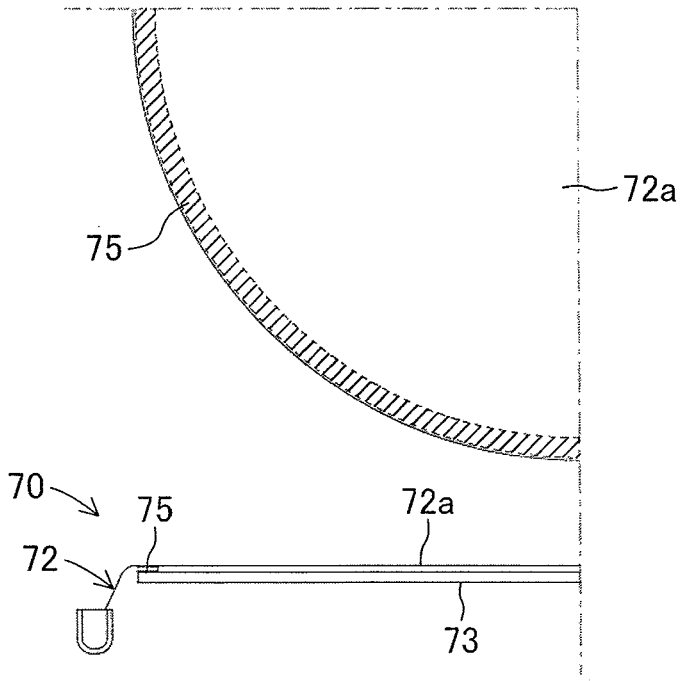
FIG. 17 is an illustration indicative of a fixing portion of a striking surface attachment fixed to a drumhead of a bass drum according to the first modification.

FIG. 17 indicates a main portion of a bass drum 70 according to the first modification of the above-described first embodiment. The bass drum 70 is designed such that a fixing portion 75 by which a striking surface attachment 73 is fixed to a head portion 72*a* of a drumhead 72 has a width of 5 mm. The bass drum 70 is also a 12-inch bass drum. For the bass drum of this size, the minimum width of the fixing portion 75 is defined at 5 mm, which is the minimum value that can prevent the striking surface attachment 73 from coming unstuck from the head portion 72*a* by tension and strikes. Therefore, the bass drum 70 can yield the maximum effect with the minimum fixing strength.

Figure 18:
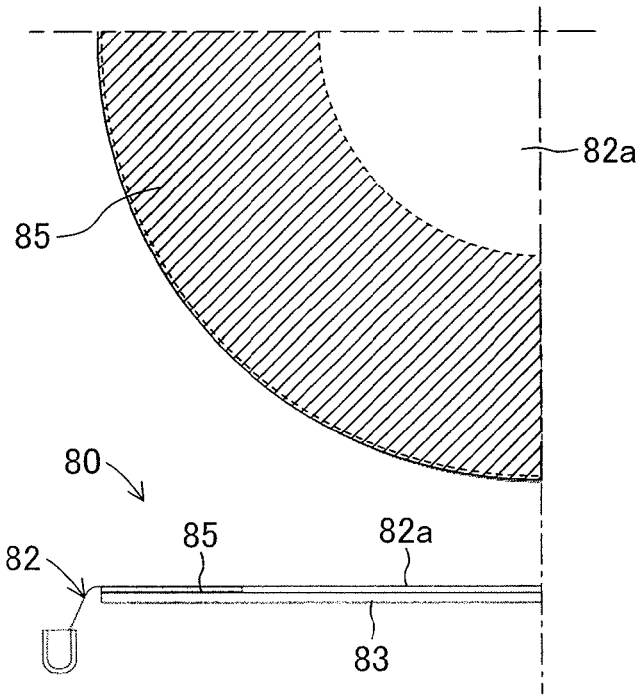
FIG. 18 is an illustration indicative of a fixing portion of a striking surface attachment fixed to a drumhead of a bass drum according to the second modification.

FIG. 18 indicates a main portion of a bass drum 80 according to the second modification of the above-described first embodiment. The bass drum 80 is designed such that a fixing portion 85 by which a striking surface attachment 83 is fixed to a head portion 82*a* of a drumhead 82 has a width of 50% of the radius of the head portion 82*a*. The bass drum 80 is also a 12-inch bass drum. For the bass drum of this size, the maximum width of the fixing portion 85 is defined at 50% of the radius of the head portion 82*a*. The thus designed bass drum 80 has the fixing portion 85 of the maximum area to securely prevent the striking surface attachment 83 from coming unstuck from the head portion 82*a*, also providing deep bass sound and attack.

In other words, it is preferable that the width in the radius direction of the fixing portion of the 12-inch bass drum is set at any desired value falling within a range from 5 mm to 50% of the radius of the head portion. This range can be also applied to the fixing portion of the bass drums 20 to 60 of the second to sixth embodiments. If the bass drum varies in size, the width of a fixing portion of the bass drum also varies according to the size. More specifically, the width of the fixing portion of the bass drum should be changed so that the width of the fixing portion will be approximately proportional to the diameter of the bass drum. The range can be thus applied to any bass drums of various sizes.

Figure 19:
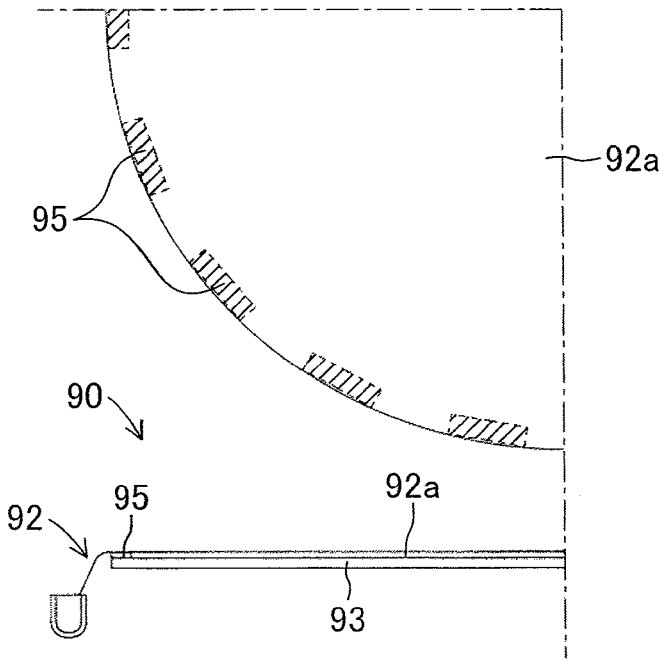
FIG. 19 is an illustration indicative of a fixing portion of a striking surface attachment fixed to a drumhead of a bass drum according to the third modification.

FIG. 19 indicates a main portion of a bass drum 90 according to the third modification of the above-described first embodiment. The bass drum 90 is designed such that a fixing portion 95 by which a striking surface attachment 93 is fixed to a head portion 92*a* of a drumhead 92 is formed not of one unit which is the entire outer area but of a plurality of parts which are apart from each other with regular intervals being provided between the parts. The fixing portion 95 is provided on 50% of the whole circumference to have a width of 10 mm. The bass drum 90 is also a 12-inch bass drum. The bass drum of this size can yield sufficient effect with the above-described fixing portion 95. The fixing portion 95 can be also applied to the bass drums 20 to 60 of the second to sixth embodiments.

Figure 20:
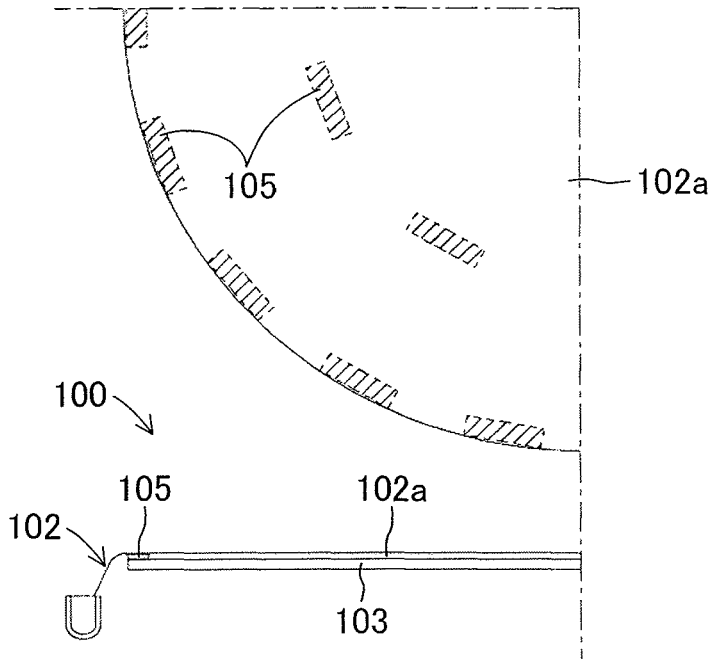
FIG. 20 is an illustration indicative of a fixing portion of a striking surface attachment fixed to a drumhead of a bass drum according to the fourth modification.

FIG. 20 indicates a main portion of a bass drum 100 according to the fourth modification of the above-described first embodiment. The bass drum 100 is designed such that a fixing portion 105 by which a striking surface attachment 103 is fixed to a head portion 102*a* of a drumhead 102 is formed of a plurality of parts which are provided on the outer area to be apart from each other with regular intervals being provided between the parts, and a plurality of parts provided inside the outer area. More specifically, the fixing portion 105 is formed of the parts configured similarly to the fixing portion 95, and the parts situated inside so that each of these parts will have the same size. Among the parts of the fixing portion 105, furthermore, the parts situated inside are located to be slightly closer to the outer rim to avoid the central portion of the drumhead 102 which is struck with the beater. The bass drum 100 is also a 12-inch bass drum. The bass drum of this size can yield sufficient effect with the above-described fixing portion 105. The fixing portion 105 can be also applied to the bass drums 20 to 60 of the second to sixth embodiments.

Figure 21:
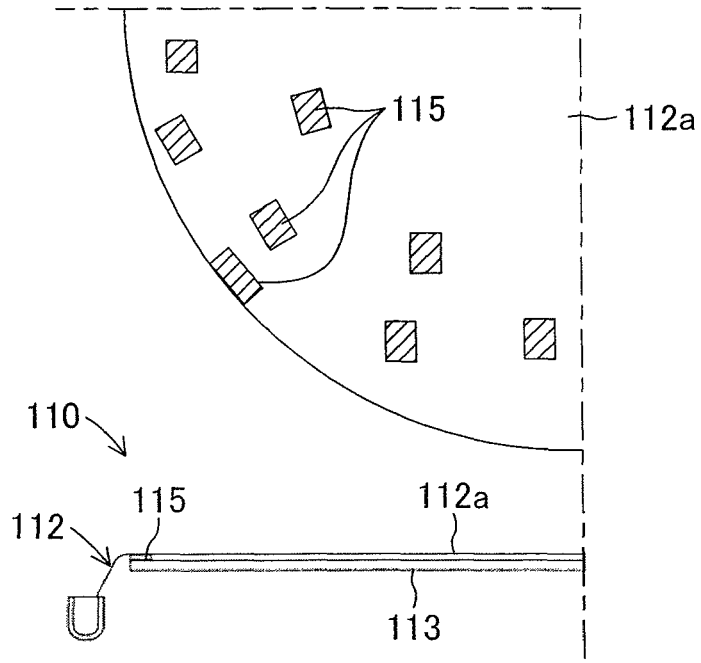
FIG. 21 is an illustration indicative of a fixing portion of a striking surface attachment fixed to a drumhead of a bass drum according to the fifth modification.

FIG. 21 indicates a main portion of a bass drum 110 according to the fifth modification of the above-described first embodiment. The bass drum 110 is designed such that a fixing portion 115 by which a striking surface attachment 113 is fixed to a head portion 112*a* of a drumhead 112 is formed of a plurality of parts which are placed randomly on the outer area. The bass drum 110 can also yield sufficient effect with the above-described fixing portion 115. The fixing portion 115 can be also applied to the bass drums 20 to 60 of the second to sixth embodiments. As different modifications, furthermore, the sound-absorbing member 69 may be used for the bass drums 10 to 50 of the first to fifth embodiments and their modifications.

The bass drum according to the present invention is not limited to the above-described embodiments and their modifications, but can be further modified. For instance, the striking surface attachments 13, 23 and so on, and the front surface attachments 43, 53 may not be single-ply, but may be multiply. Furthermore, the striking surface attachments 13, 23 and so on, and the front surface attachments 43, 53 may not be made of nitrile rubber, but may be made of a different kind of rubber, elastomer or the like. Briefly speaking, the striking surface attachments 13, 23 and the front surface attachments 43, 53 may be formed of any sheet materials as long as the sheet materials have elasticity and flexibility, and can increase the mass without disturbing vibrations of the head portions 12*a*, 13*a* and so on.

Furthermore, the way by which the striking surface attachments 13, 23 and so on, and the front surface attachments 43, 53 are fixed to the head portion 13*a* and the head portion 46*a* is not limited to adhesion by use of the double-faced tape 13*a* and the like, but may be fixing by use of a bonding adhesive or by use of a fixing member such as rivets or staples of stapler. Furthermore, the material of the head portions 12*a*, 13*a* and the like is not limited to PET film, but may be any other high polymer film having characteristics similar to PET film. As the sound-absorbing member 69, not only urethane foam but also glass wool fiber material, sponge or the like can be used.

Furthermore, the drumhead 12 and the like to which the striking surface attachment 13 is attached may not be previously incorporated into the bass drum, but may be separately added. In this case, it is preferable to prepare different kinds of drumheads each having a different fixing potion so that a player can choose and use a player's desired one. For the striking surface attachment 13 and the like, furthermore, by preparing different kinds of striking surface attachments having an adhesive agent or bonding adhesive on a part which will be fixed to the drumhead, in other words, by preparing different kinds of striking surface attachments each having a different fixing portion, the player can choose a player's desired striking surface attachment according to the player's purpose to fix the selected striking surface attachment to the drumhead.

By adopting the above-described schemes, modes of use are widely broadened to improve usability of the bass drum. Furthermore, although the above-described embodiments and modifications are described as a 12-inch small bass drum, it goes without saying that the bass drum according to the present invention can be applied to bass drums of various sizes ranging from small bass drums to large bass drums irrespective of size. Furthermore, the other configurations of the bass drum 10 and the like can be also modified within the technical scope of the present invention.

What is claimed is:

1. A bass drum, comprising:

a hollow cylindrical shell;

a drumhead extending across an open end of the shell, wherein the drumhead includes a striking surface having an outer periphery located adjacent the shell, and wherein the striking surface extends across a center of the drumhead, and wherein the drumhead has an opposing surface facing the striking surface; and an elastic sheet coupled to the opposing surface at one or more fixing locations which are located within the outer periphery of the striking surface, the elastic sheet extending radially inward from the fixing locations across the center of the drumhead.

2. The bass drum according to claim 1, wherein the elastic sheet has a lower stiffness and higher specific gravity than the drumhead.

3. The bass drum according to claim 1, further comprising a fixing portion for fixing the elastic sheet to the drumhead, and wherein the fixing portion has a width in a radial direction of the drumhead of between 5 mm and 50% of a radius of the drumhead.

4. The bass drum according to claim 1, wherein the elastic sheet extends over the entire area of the striking surface.

5. The bass drum according to claim 1, wherein the elastic sheet is coupled to the opposing surface at a plurality of spaced locations.

6. The bass drum according to claim 1, further comprising: a sound-absorbing member placed on an inner surface of the shell.

7. The bass drum according to claim 1, wherein the elastic sheet is coupled to the opposing surface by a continuous fixing member extending along the periphery of the striking surface.

8. The bass drum according to claim 1, wherein the drumhead is removably attached to the shell.

9. The bass drum according to claim 1, wherein the elastic sheet is coupled to the opposing surface in such a manner that the elastic sheet faces, but is spaced from, the opposing surface when the striking surface is not struck.

10. The bass drum according to claim 1, further comprising: a front head mounted on another open end of the shell, the front head having an active surface which vibrates in response to vibrations of the striking surface, the active surface having a periphery.

11. The bass drum according to claim 10, wherein the front head has an air vent.

12. The bass drum according to claim 10, further comprising: a second elastic sheet coupled to one of a front side or a back side of the front head at one or more fixing locations which are located within the periphery of the active surface and extends radially inward from the fixing locations of the second elastic sheet, the second elastic sheet being coupled to the one side of the front head in such a manner that the second elastic sheet faces, but is spaced from, the one side of the front head when the striking surface is not struck.

13. The bass drum according to claim 12, wherein the front head and the second elastic sheet have an air vent.

14. The bass drum according to claim 1, wherein the elastic sheet is coupled to the opposing surface by one or more fixing members.

15. The bass drum according to claim 14, wherein the one or more fixing members are a plurality of spaced fixing members.

16. The bass drum according to claim 14, wherein at least some of the fixing members are double sided tape.

17. The bass drum according to claim 14, wherein the fixing members allow the elastic sheet to be removable attached to the drumhead.

* * * * *